US006408857B1

(12) United States Patent
Neuner

(10) Patent No.: US 6,408,857 B1
(45) Date of Patent: Jun. 25, 2002

(54) COMBINATION COSMETIC APPLICATOR BRUSH AND COMB

(75) Inventor: Charles P. Neuner, Amityville, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/618,351

(22) Filed: Jul. 19, 2000

(51) Int. Cl.[7] ..... A45D 40/26
(52) U.S. Cl. ..... 132/218; 15/206; 401/129
(58) Field of Search ..... 132/120, 121, 132/142, 148, 218, 313, 317, 320; 15/105, 206; 401/16, 118, 126, 127, 129, 268

(56) References Cited

U.S. PATENT DOCUMENTS

| | | | | | |
|---|---|---|---|---|---|
| 2,194,484 | A | * | 3/1940 | Segal | 132/120 |
| 2,226,318 | A | * | 12/1940 | Nelson | 132/120 |
| 2,569,908 | A | * | 10/1951 | Twitty | 132/120 |
| 2,617,432 | A | * | 11/1952 | Hertzberg | 132/120 |
| 3,908,676 | A | * | 9/1975 | Levine et al. | 132/88.7 |
| 3,921,650 | A | * | 11/1975 | Montgomery | 132/88.7 |
| 4,566,472 | A | * | 1/1986 | Mueller et al. | 132/112 |
| 4,733,425 | A | | 3/1988 | Hartel et al. | 15/206 |
| 4,810,122 | A | | 3/1989 | Cole | 401/122 |
| 4,861,179 | A | | 8/1989 | Schrepf et al. | 401/129 |
| 4,886,080 | A | | 12/1989 | Cole | 132/320 |
| 4,887,622 | A | | 12/1989 | Gueret | 132/320 |
| 5,238,011 | A | | 8/1993 | Gueret | 132/218 |
| 5,761,760 | A | | 6/1998 | Dumler et al. | 15/206 |
| 5,970,990 | A | | 10/1999 | Dunton et al. | 132/218 |

FOREIGN PATENT DOCUMENTS

| | | | | |
|---|---|---|---|---|
| FR | 2598299 | * | 11/1987 | 132/218 |

* cited by examiner

*Primary Examiner*—Pedro Philogene
*Assistant Examiner*—David C. Comstock
(74) *Attorney, Agent, or Firm*—Martin W. Haerter, Esq.

(57) ABSTRACT

A comb insert is disclosed for a cosmetic brush that has a bristle portion with a twisted wire core bent into a closed loop. The comb insert has a base with teeth extending from at least one surface. The base of the comb insert is provided with a groove that engages the core of the brush forming the loop in interference fit to secure the comb insert in the loop.

12 Claims, 4 Drawing Sheets

Fig. 4
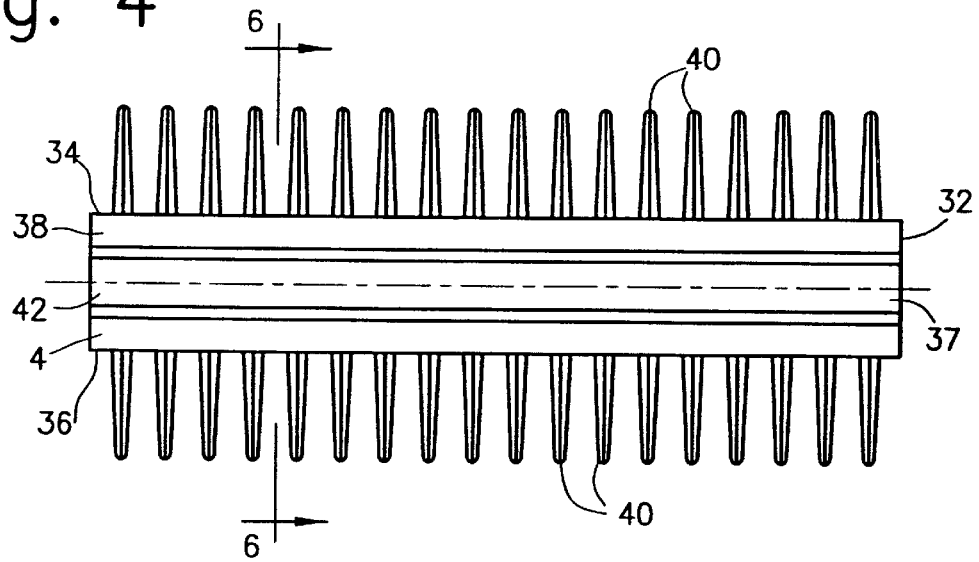
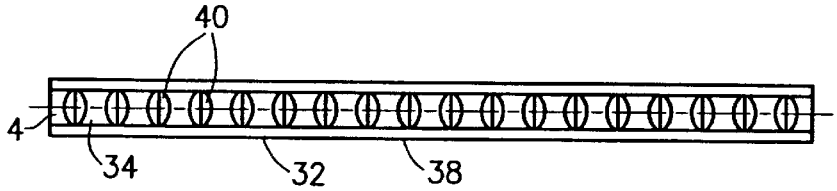
Fig. 5
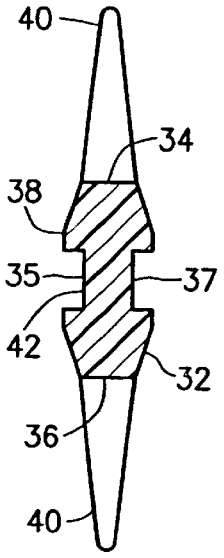
Fig. 6
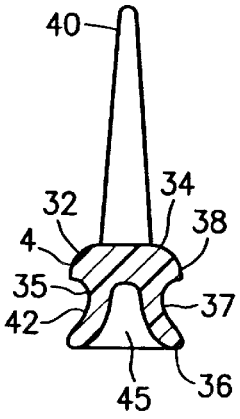
Fig. 7
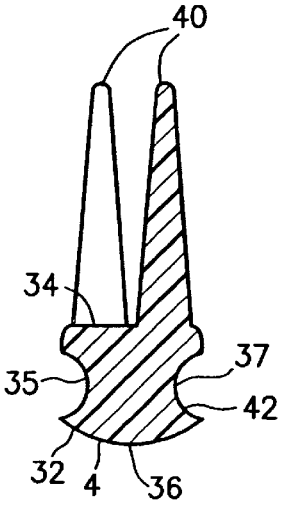
Fig. 8
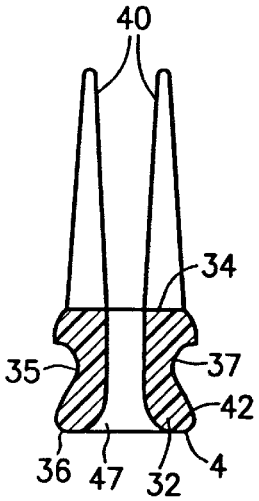
Fig. 9

COMBINATION COSMETIC APPLICATOR BRUSH AND COMB

BACKGROUND OF THE INVENTION

1. Field of the Invention:

The present invention relates generally to the field of cosmetic applicators, and specifically to a brush applicator and comb combination, e.g. for applying mascara. In the bristle portion of the brush, the brush core forms a loop. The base of a comb is secured in the loop such that comb teeth extend from the loop.

2. Description of the Prior Art:

The conventional purpose of a cosmetic brush is to apply cosmetic to an application area, e.g., mascara to a user's eyelashes, preferably in a uniform manner in as few steps as possible. In the case of cosmetics applied to hair or lashes, such as, for example, mascara, a complete application typically requires a coating step and a doctoring step. The coating step is preferably accomplished by transferring cosmetic from the relatively soft bristles of a brush to the hair or lashes. The doctoring step, which includes removing clumps of excess cosmetic and separating the individual hairs or lashes, is preferably accomplished with the relatively stiff bristles of a brush or teeth of a comb. To avoid the clutter and inconvenience of providing each of these functions in separate tools (i.e., an applicator brush with soft bristles and a doctoring brush or comb with stiffer bristles or teeth), at least one device combines a brush and comb in a single cosmetic applicator (see U.S. Pat. No. 5,970,990 to Dunton et al.). As disclosed by Dunton et al., a comb is attached to the handle end of an applicator brush by way of a pivot that permits the comb to swing into a storage compartment in the S handle portion of the applicator device. Thus, while the comb is conveniently part of the applicator structure, its use nevertheless requires additional effort on the part of the user, i.e., replacing the brush in the cosmetic storage container and pivoting the comb from within its storage compartment to use it.

Brushes said to be capable of accomplishing to a degree both application and combing have been achieved by mixing bristles having different characteristics in a single bristle head, or, in a brush having one bristle type throughout the bristle head, by compromising the characteristics of individual bristles. An example of a brush that is said to provide improved application and combing characteristics with mixed bristles is shown in U.S. Pat. No. 4,861,179 to Schrepf et al., which discloses a brush having a combination of soft bristles and stiff bristles. An example of a brush that is said to provide improved application and combing characteristics with uniform bristles throughout the bristle head is shown in U.S. Pat. No. 5,238,011 to Gueret, which discloses bristles of what is said to be a larger than typical diameter made of what is said to be a softer than typical material (shore hardness of 20A to 40D). Each of the foregoing examples is of a brush having a core of typical twisted wire construction.

A typical mascara brush is comprised of a core formed from a single metallic wire folded in a generally u-shaped configuration to provide a pair of parallel wire segments. Bristles (also referred to as filaments or fibers), usually comprised of strands of nylon, are disposed between a portion of a length of the wire segments. The wire segments are then twisted, or rotated, about each other to form a helical core (also known as a twisted wire core) which holds the filaments substantially at their midpoints so as to clamp them. In this way, a bristle portion or bristle head is formed with radially extending bristles secured in the twisted wire core in a helical or spiral manner. See, for example, U.S. Pat. No. 4,887,622 to Gueret, and U.S. Pat. No. 4,733,425 to Hartel et al. The twisted wire core may be bent to form a closed loop as shown, for example, in U.S. Pat. No. 5,761,760 to Dumler et al., incorporated by reference herein in its entirety. The purpose of the loop in the brush disclosed in the Dumler et al. reference is to provide a reservoir for retaining and transferring mascara or other pasty product from the mascara container to the eyelashes.

A brush with a comb insert conveniently located in the bristle portion of the brush is not disclosed in the foregoing disclosures.

BRIEF SUMMARY OF THE INVENTION

A comb insert for a brush, or brush and a comb insert combination, are disclosed wherein the brush has a bristle portion with a core forming a loop. The comb insert has a base with opposite face surfaces connected by a peripheral wall. Comb teeth extend from at least one of the face surfaces. To secure the comb to the brush, a groove is provided in the peripheral wall. The groove is dimensioned to receive a sufficient portion of the core of the brush forming the loop in interference fit to secure the base of the comb in the loop.

BRIEF DESCRIPTION OF THE DRAWINGS

FIG. 4 is an elevation view of a further embodiment of the comb insert;

FIG. 5 is a plan view of either the comb insert shown in perspective view in FIGS. 1–2, or alternatively of the comb insert embodiment shown in elevation view in FIG. 4;

FIG. 6 is a cross-sectional view of the embodiment of the comb insert taken along sectional line 6—6 in FIG. 4;

FIG. 7 is a cross-sectional view of an alternative embodiment with a base including a product reservoir;

FIG. 8 is a cross-sectional view of an alternative embodiment with a double row of teeth extending from one face in staggered relationship;

FIG. 9 is a cross-sectional view of an alternative embodiment with a double row of teeth separated by a product reservoir clearance;

DETAILED DESCRIPTION OF THE INVENTION

Figure 1:
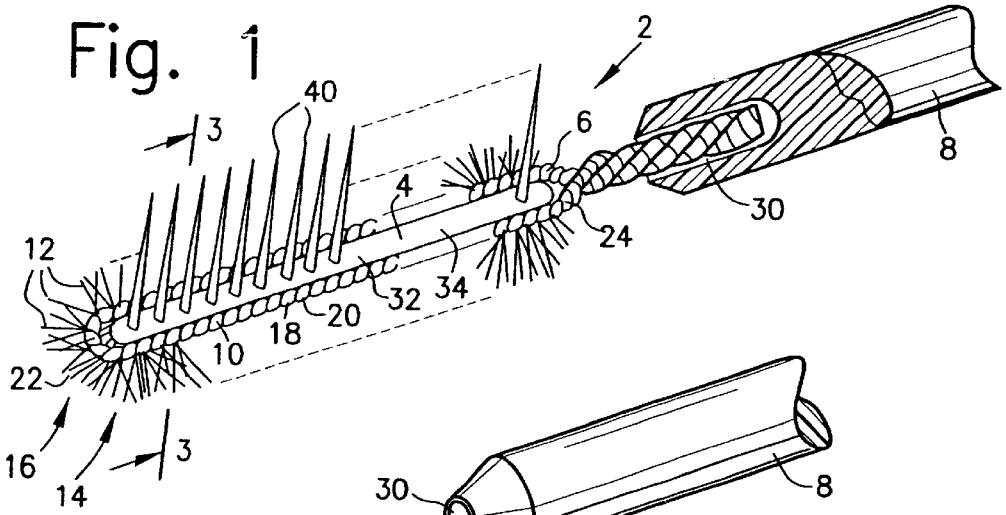
FIG. 1 is perspective view illustrating the brush and comb insert combination of the present invention.
Figure 14:
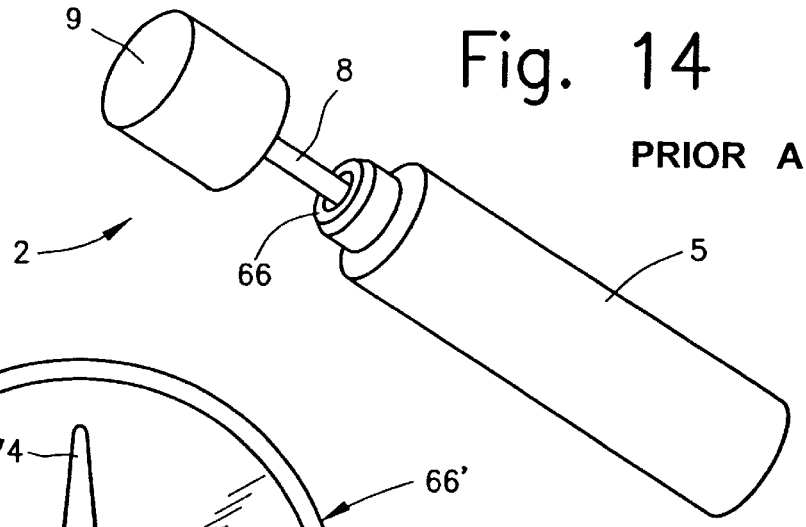
Fig. 14 PRIOR ART
FIG. 14 is a perspective view of a package in which the brush/comb combination of the present invention may be used.

Referring now to FIG. 1, the brush and comb insert combination of the present invention is shown generally at 2 in perspective view. The reader's attention is also directed to FIG. 2, which shows the brush and comb insert in an exploded, perspective view illustrating the separated main components of the combination. In all of the illustrations showing bristles, for the sake of clarity, the bristles are shown in a merely representative manner. The combination 2 comprises a comb insert 4 and a brush 6. The brush 6 may include a shaft 8 that connects the brush to a handle or cap and handle combination 9 (see FIG. 14) typical for such brushes. The comb insert and brush combination 2 may be stored in a container 5 (FIG. 14), such as, for example, a mascara container.

The brush 6 has a core 10 formed from a pair of wire segments 18, 20 intertwisted as described above. A first length of the core 10 comprises a brush portion 14 that is defined by a plurality of bristles 12 secured between the pair of intertwisted wire segments 18, 20. The bristles 12 are secured at their midpoints between the intertwisted wire segments 18, 20 of the core 10 such that opposite ends of each bristle extend radially from the core 10. A second length of the core is bent to form a loop 16, preferably at least part of which includes at least part of the brush portion 14. In the preferred embodiment shown in FIGS. 1 and 2, the first length of the core forming the brush portion 14 and the second length of the core forming the loop 16 are substantially of equal length and coextensive. However, it will be understood that configurations are contemplated wherein the brush portion 14 and the loop 16 are not coextensive either because each has a different length, and/or because each has a length offset relative to the length of the other.

In the preferred embodiment of the present invention, the intertwisted wire core 10 including the bristles 12 is bent to form a distal end 22 of the loop. The free ends 26, 28 of the bent core 10 are then intertwisted with each other to form a proximal end 24 of the loop 16 that is closed. Alternatively, the free ends 26, 28 of the bent core 10 may terminate in a spaced relationship (not shown) wherein the proximal end 24 of the loop is open, not closed. In either case, at least one or both of the free ends 26, 28 of the core 10 extend proximally from the loop 10 to be received and fixedly mounted in a bore 30 (or bores) in shaft 8 by well known methods, e.g., interference fit, adhesive, welding, overmolding, etc.

The loop 16 may take on any of a number of spacial configurations including but not limited to, the configurations as disclosed in U.S. Pat. No. 5,761,760 to Dumler et al., incorporated herein in its entirety by reference. As disclosed by Dumler et al., the loop 16 may be configured to act as a reservoir for transporting liquid or pasty product from a storage chamber to the application area. Alternatively, the loop 16 may be configured for esthetic reasons, for supporting the comb insert (described in greater detail below), or for any combination of the above reasons.

Figure 16:
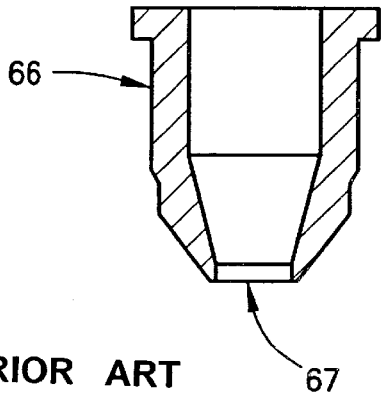
PRIOR ART Fig. 16
FIG. 16 is a sectional view of a conventional wiper.
Figure 17:
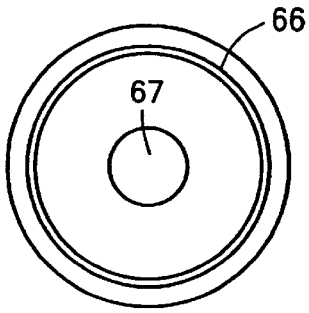
PRIOR ART Fig. 17
FIG. 17 is a plan view of the conventional wiper shown in FIG. 16.

The comb insert 4 has a base 32 with opposite face surfaces 34, 36 (also see FIG. 3) connected by a peripheral wall 38. The peripheral wall 38 defines a circumference about the base 32 of the comb insert 4. A plurality of teeth 40 extend from one or both of the face surfaces 34, 36 (also see FIG. 4) of the base 32. The comb insert 4, i.e., the base 32 and teeth 40, is preferably a single integrally molded unit. The comb insert 4 may be molded from one or more materials using typical plastic manufacturing methods well known in the art, such as, for example, injection molding. Although any one of a number of well known plastic materials may be used to form the comb insert 4, the material selected for the preferred embodiment is, for example, LDPE (low density polyethylene). The material for the comb insert 4 should be selected to be compatible with the product being applied. To provide the desired degree of combing ability, the material for the comb insert 4 and the dimensions of the teeth 40 are selected in combination to provide teeth 40 that are preferably stiffer than the bristles 12. To avoid having to align a particular brush/comb cross-sectional shape with a corresponding cooperatively shaped opening in a wiper (see discussion below), the material of the comb insert and the dimensions of the teeth 40 are also preferably selected to have a degree of flexibility that permits the combined brush and comb insert 2 to pass through a conventional wiper 66 with a round opening 67 (see FIGS. 16 and 17).

Means are provided on the base 32 for securing the base to the loop 16. The means for securing the base 32 to the loop 16 essentially consists of at least two clearances 35, 37 each positioned opposite the other about the circumference. Each clearance 35, 37 opens outwardly relative to the circumference and is dimensioned to receive an inwardly directed part of the cross section of the second length of the core forming the loop. The clearances are spaced from each other such that the corresponding inwardly directed parts of the cross section of the core of the loop are received in interference fit.

Figure 2:
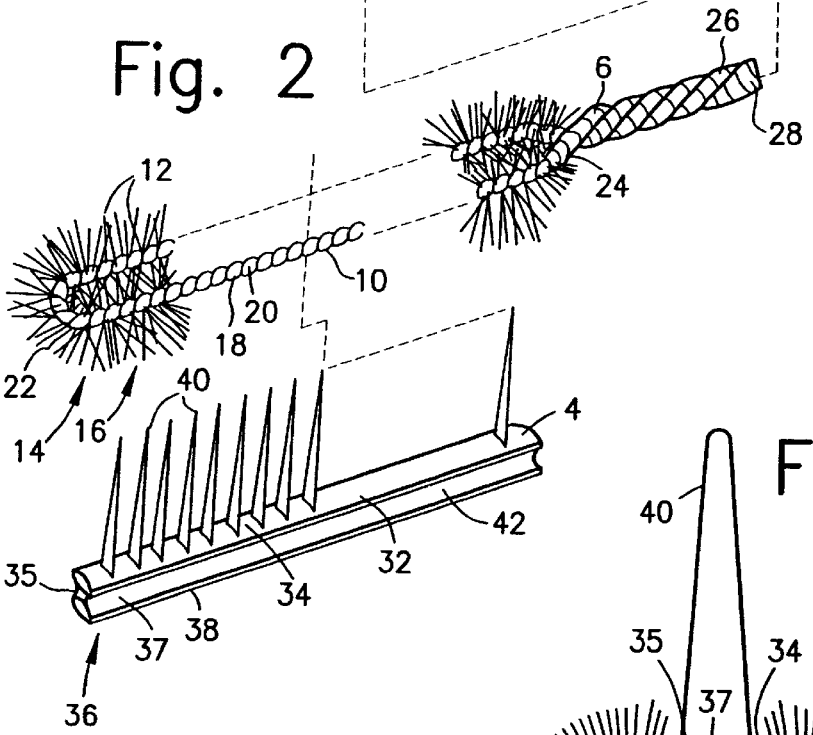
FIG. 2 is an exploded, perspective view of the main components of the brush and comb insert combination.
Figure 3:
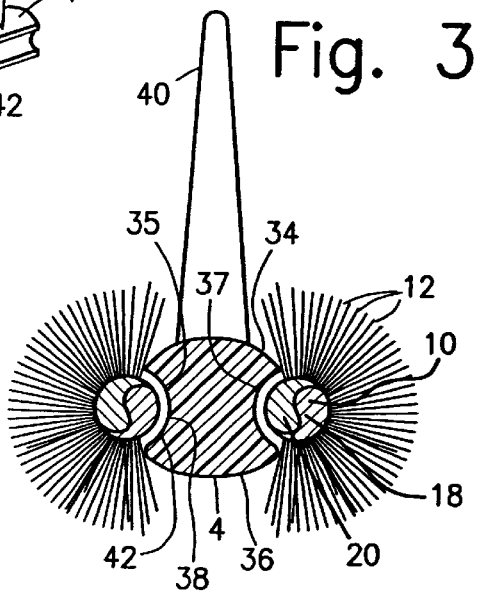
FIG. 3 is a cross-sectional view of the brush and comb insert combination taken along sectional line 3—3 in FIG. 1.

In the preferred embodiment shown in FIGS. 1–3, the clearances 35, 37 in the sidewall 38 comprise part of an annular groove 42 arranged about the circumference of the base 32. The groove 42 opens outwardly relative to the circumference and is dimensioned to receive in interference fit an inwardly directed part of the cross section of the core 10 forming the loop 16. Accordingly, the greatest width of the base is slightly larger than the width of the opening defined by the loop 16, and the width of the base measured within the groove 42 is slightly less than the width of the opening defined by the loop 16. This relationship of the width of the base to the width of the loop is apparent from an inspection of FIG. 3, a cross-sectional view of the brush and comb insert combination taken along sectional line 3—3 in FIG. 1. In FIG. 3, the slight gap between the core 10 and the groove 42 is for illustrative purposes. With the comb insert installed securely in the loop 16, the gap would normally not be apparent, the groove being dimensioned to receive the core snugly. The gap, if any, would be occupied by bristles trapped between the core and the groove.

It will be understood that, before the comb insert is mounted in the loop, the bristles 12 may extend radially outwardly from the core in all directions. Thus, at least some bristles are directed inwardly towards the interior of the loop. However, when the base of the comb insert shown in FIGS. 1–4 is forced in the loop, these inwardly directed bristles yield in the path of the base and may bend such that they are directed out of the loop above and below the base.

It will be understood that for the intended purpose of combing out eyelashes, the entire length of the core 10 forming loop 16 need not engage a groove of corresponding length. For example, instead of a continuous annular or circumferential groove, clearances sufficient to securely mount the comb insert 4 in the loop 16 can take the form of groove-like means, e.g., grooves or notches spaced in annular arrangement about the circumference. Each clearance is spaced from the other to receive a respective inwardly directed part of the cross section of the core in interference fit.

The comb insert 4 is assembled with the brush 6 by press-fitting or snap-fitting the base 32 of the comb insert 4 into the loop 16 such that the clearances 35 and 37 engage a part of the cross-section of the core 10 in interference fit. Thus, the base of the comb insert is configured and is made of a material with enough elasticity to permit it to deform sufficiently to be forced into the loop. Alternatively, the base may be installed within the loop before the final twisting of the free ends 26, 28 of the core. Subsequent final twisting of the free ends 26, 28 of the core will close the dimensions of the loop to lock the base in the loop.

An alternative embodiment of the comb insert is shown in an elevation view in FIG. 4. FIG. 5 is a plan view of the comb insert embodiment shown in elevation view in FIG. 4. FIG. 6 is a cross-sectional view of the same embodiment taken along line 6—6 in FIG. 4. As shown in FIGS. 4–6, this embodiment of the comb insert 4 has a base 32 with opposite face surfaces 34, 36. Comb teeth 40 extend upwardly from face surface 34 and downwardly from face surface 36. The other elements of the embodiment, are essentially the same as those shown in FIGS. 1–3, including the groove 42 in the base which is dimensioned to be received in a loop 16 similar to that shown in FIGS. 1–3.

An alternative embodiment of the comb insert 4 having a base 32 including a product reservoir 45 in face surface 36 is shown in cross-sectional view in FIG. 7. The reservoir 45 can take the form of a channel along the entire length of the base 32, or alternatively, can be a series of bores or channels along the length of the base 32.

FIG. 8 is a cross-sectional view of an alternative embodiment of a comb insert 4 that has a double row of teeth 40 extending from face surface 34. The teeth 40 are staggered along the length of the base 32.

FIG. 9 is a cross-sectional view of an alternative embodiment of a comb insert 4 with a double row of teeth 40 extending from face surface 34. The two rows of teeth 40 are separated by a product reservoir 47 that passes from face surface 34 through the base 32 to face surface 36. As in the embodiment shown in FIG. 7, the reservoir 47 can take the form of a clearance along the entire length of the base 32, or alternatively, can be a series of bores or channels along the length of the base 32.

Figure 10:
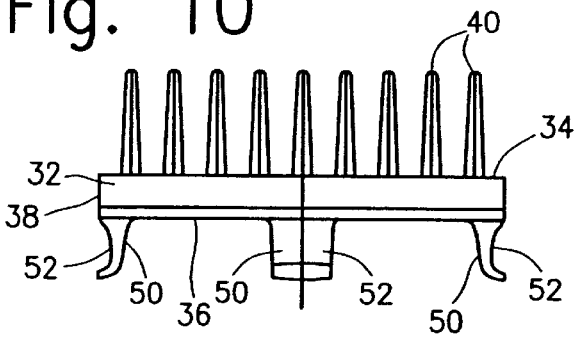
FIG. 10 is an elevation view of an alternative embodiment of the comb insert with the attaching means comprising struts extending opposite the teeth to support core grasping clearances.

FIG. 10 is an elevation view of an alternative embodiment of the comb insert 4 wherein the attaching means comprise a series of struts 50 extending from the base 32 in a direction away from the teeth 40. The struts 50 support clearances 52 offset from the sidewall 38 of the base 32 in an annular arrangement about the perimeter of the base 32. The struts 50 are spaced and the clearances 52 dimensioned is such that the comb insert may be suitably secured to a loop 16 such as that shown in FIG. 2 by pressing outwardly against inwardly directed surfaces of the core 10 of the loop. This strut arrangement offsets the base 32 of the comb insert 4 to a position outside the interior of the loop 16, thus opening the interior volume of the loop for product storage. The arrangement also permits at least some bristles 12 to extend into the interior of the loop 16 where the bristles can facilitate the retention of product in the reservoir clearances by providing additional surfaces for the product to cling to.

Figure 11:
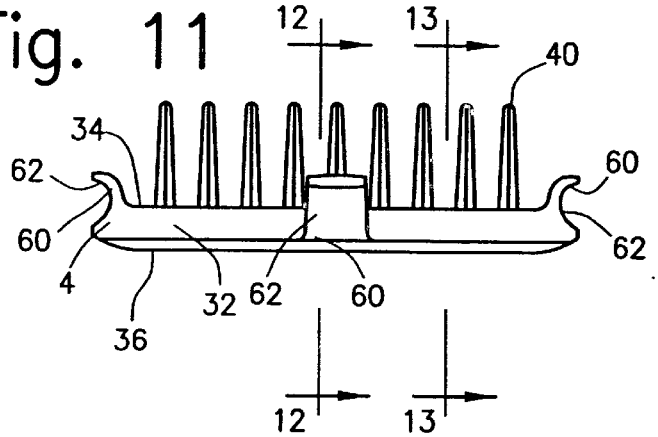
FIG. 11 is an elevation view of another alternative embodiment of the comb insert with the attaching means comprising struts extending coextensive to the teeth to support core grasping clearances.

FIG. 11 is an elevation view of another alternative embodiment of the comb insert 4 wherein the attaching means comprise struts 60 extending from the base 32 coextensive to the teeth 40. The struts 60 support clearances 62 that are partially offset from the sidewall 38 of the base 32.

Figure 13:
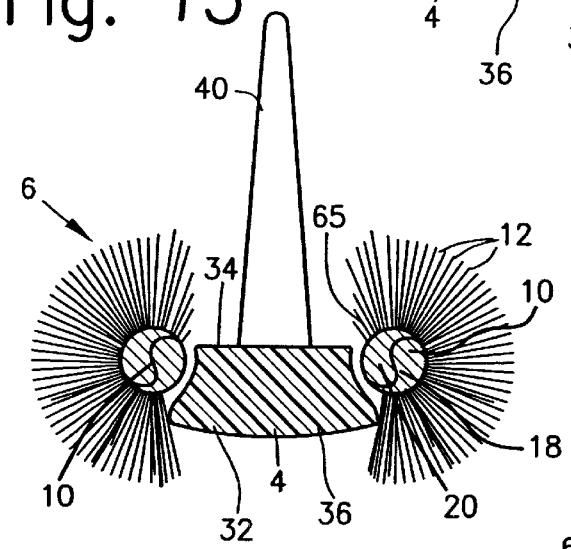
FIG. 13 is a cross-sectional view of a brush and comb insert combination illustrating product reservoir clearances formed between the teeth of the comb insert embodiment of FIG. 11 (i.e., at sectional line 13—13) and the bristles of a brush if the embodiment were mounted in a brush loop.
Figure 12:
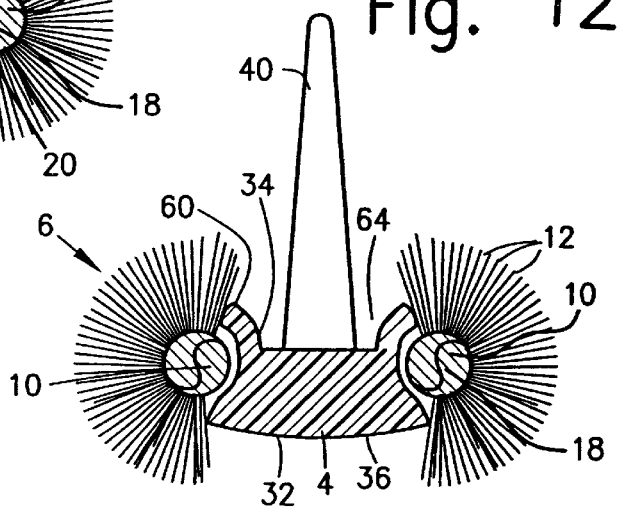
FIG. 12 is a cross-sectional view of a brush and comb insert combination illustrating product reservoir clearances formed between the teeth of the comb insert embodiment of FIG. 11 and the support struts (as shown by sectional line 12—12 in FIG. 11)

FIG. 12 is a cross-sectional view of a brush and comb insert combination illustrating product reservoir clearances 64 defined between the teeth 40 of the comb insert 4 and the means for securing the comb insert to the loop. For example, where the teeth 40 extend from within a recess in face surface 34 and the means for securing is a continuous structure about the circumference of the base 32 (not illustrated), the product reservoir clearance 64 could be defined between teeth 40 and the walls of the recess. Alternatively, the product reservoir clearances 64 may be defined between the teeth 40 and the support struts 60 (as shown by sectional line 12—12 in FIG. 11). In the latter case, a product reservoir clearance 65 (FIG. 13) having a greater volume is defined between the teeth 40 and the bristles 12 of the brush 6 along the portions of the comb insert 4 that do not have struts 60 (as illustrated by FIG. 13, which is taken along sectional line 13—13 in FIG. 11). This arrangement also permits at least some bristles 12 to extend into the interior of the loop 16 where the bristles can facilitate the retention of product in the reservoir clearances by providing additional surfaces for the product to cling to (see FIG. 13).

A typical package for cosmetic such as mascara includes a container 5 (see FIG. 14) with a wiper 66 within a container opening for removing excess product from the applicator. Accordingly, the container 5 in which the brush and comb insert combination 2 is to be used may have a wiper 66 in the container opening. A conventional wiper, such as, for example, that shown in FIGS. 16–17, has a round opening 67. To avoid having to align a particular brush/comb cross-sectional shape with a corresponding cooperatively shaped opening in a wiper, the material and the dimensions of the teeth 40 of the comb insert 4 are preferably selected to have a degree of flexibility that permits the combined brush and comb insert 2 to pass through the round opening 67 of a conventional wiper 66.

Figure 15:
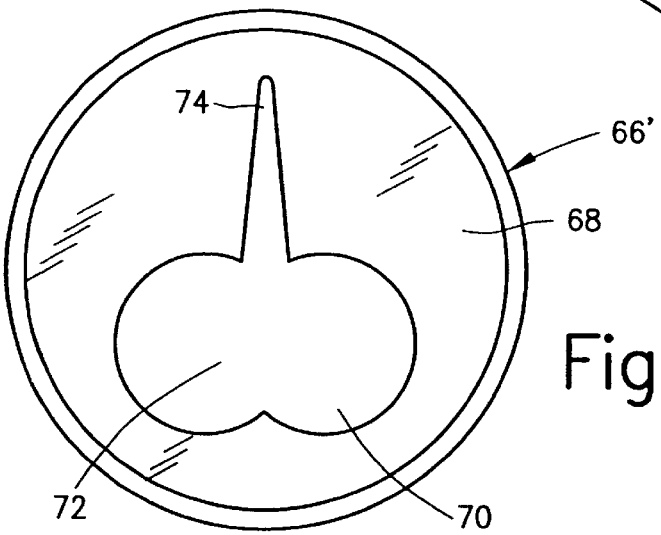
FIG. 15 is a plan view of a wiper that may be used in connection with the brush/comb combination of the present invention.

Alternatively, for comb inserts with stiffer teeth, a wiper 66' may be provided to have a body 68 with an opening 70 (see FIG. 15) corresponding in shape to the sectional shape of the combined brush/comb 2, e.g., the sectional shape of the brush comb shown in FIGS. 1–3. This shaped opening 70 cooperatively acts to remove or strip excess product (e.g., mascara) from the brush 6 and teeth 40 of the comb insert 4 as the combination is withdrawn from the container 5. The opening 70 may have a first portion 72 configured to strip excess product from the brush, and a second portion 74 configured to strip excess product from the teeth 40 of the comb insert 4. It will be understood that the configuration shown in FIG. 15 is merely exemplary and illustrative of a configuration that could work with the cross-sectional configuration of the embodiment of the brush and comb shown in FIGS. 1–3. Examples of other configurations possible for the wiper opening 70 are shown in U.S. Pat. No. 4,810,122, incorporated herein by reference in its entirety.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A comb insert for a cosmetic brush having a core formed from a pair of intertwisted wire segments, a first length of the core comprising a brush portion defined by a plurality of bristles secured between the pair of intertwisted wire segments, and a second length of core forming a closed loop at least part of which includes the brush portion, the comb insert comprising:

a base having opposite face surfaces connected by a peripheral wall, the peripheral wall defining a perimeter;

a plurality of teeth extending from at least one of the face surfaces; and means on the base for securing the base to the loop, the means having at least two clearances each positioned opposite the other about the perimeter, each opening outwardly relative to the perimeter and dimensioned to receive an inwardly directed part of the cross section of the second length of the core forming the loop, each clearance spaced from the other to receive the respective inwardly directed part of the cross section in interference fit.

2. The comb insert of claim 1 wherein at least one of the at least two clearances comprises a portion of an annular groove arranged about the perimeter of the base.

3. The comb insert of claim 2 wherein the groove is in the peripheral wall.

4. The comb insert of claim 1 wherein at least one of the at least two clearances is supported on a strut extending from the base.

5. The comb insert of claim 1 wherein a product reservoir is defined in at least one of the opposite face surfaces of the base.

6. A mascara brush and comb combination comprising:

a cosmetic brush having a core formed from a pair of intertwisted wire segments, a first length of the core comprising a brush portion defined by a plurality of bristles secured between the pair of intertwisted wire segments, and a second length of the core forming a closed loop at least part of which includes the brush portion; and a comb insert comprising:

a base having opposite face surfaces connected by a peripheral wall, the peripheral wall defining a perimeter;

a plurality of teeth extending from at least one of the face surfaces; and means on the base for securing the base to the loop, the means having at least two clearances each positioned opposite the other about the perimeter, each opening outwardly relative to the perimeter and dimensioned to receive an inwardly directed part of the cross section of the second length of the core forming the loop, each clearance spaced from the other such that the respective inwardly directed part of the cross section is received in interference fit.

7. The mascara brush and comb combination of claim 6 wherein at least one of the at least two clearances comprises a portion of an annular groove arranged about the perimeter of the base.

8. The mascara brush and comb combination of claim 7 wherein the groove is in the peripheral wall.

9. The mascara brush and comb combination of claim 6 wherein at least one of the at least two clearances is supported on a strut extending from the base.

10. The mascara brush and comb combination of claim 6 wherein at least one of the brush or the comb define a product storage reservoir.

11. The mascara brush and comb combination of claim 10 wherein the storage reservoir is a clearance or a bore defined in the base.

12. The mascara brush and comb combination of claim 10 wherein the reservoir is a clearance defined between the brush and the comb.

* * * * *